US007270330B2

(12) United States Patent
Falciglia, Sr.

(10) Patent No.: US 7,270,330 B2
(45) Date of Patent: Sep. 18, 2007

(54) METHOD AND SYSTEM FOR PLAYING A POKER GAME ENABLING BONUS BETS

(76) Inventor: Sal Falciglia, Sr., 386 Highview Ter., Ridgewood, NJ (US) 17450

( * ) Notice: Subject to any disclaimer, the term of this patent is extended or adjusted under 35 U.S.C. 154(b) by 16 days.

(21) Appl. No.: 11/225,791

(22) Filed: Sep. 13, 2005

(65) Prior Publication Data

US 2006/0290060 A1 Dec. 28, 2006

Related U.S. Application Data

(60) Provisional application No. 60/693,559, filed on Jun. 23, 2005.

(51) Int. Cl.
*A63F 1/00* (2006.01)

(52) U.S. Cl. ..... 273/292; 273/274; 463/12; 463/13

(58) Field of Classification Search ..... 273/292, 273/274, 309; 463/12, 13, 20, 42
See application file for complete search history.

(56) References Cited

U.S. PATENT DOCUMENTS 6,719,291 B1 * 4/2004 deKeller ..... 273/274
2005/0269775 A1 * 12/2005 Sorge ..... 273/274

* cited by examiner

*Primary Examiner*—Benjamin Layno

(57) ABSTRACT

Computerized and gaming table versions of a poker game with bonus bets is provided where a player plays a poker game with the option to place bonus bets.

11 Claims, 10 Drawing Sheets

METHOD AND SYSTEM FOR PLAYING A POKER GAME ENABLING BONUS BETS

PRIORITY

This application claims priority from a United States Provisional Application filed on Jun. 23, 2005 and assigned U.S. Provisional Application Ser. No. 60/693,559. The contents of the provisional application are incorporated herein by reference.

FIELD OF THE INVENTION

The present invention relates generally to gaming systems, and more specifically to a method and system for playing a poker game enabling bonus bets.

BACKGROUND OF THE INVENTION

The gaming industry has come to recognize that to sustain long term success it must be constantly innovative in introducing new games and new gambling concepts to the gaming public. One example of this innovating drive can be appreciated in the embrace of the Internet and online gaming by the gaming industry. Presently, most games found in casinos, both brick-and-mortar and online, have centered on the traditional games associated with the gaming industry.

The new market for the gaming industry and perhaps most especially the online gaming industry is that group of individuals who find the traditional games too complex or simply not exciting enough. In the drive to attract greater numbers of players, offline and online gaming manufacturers and casinos strive to include games that are familiar, simple to understand, engaging, and entertaining.

Perhaps, the one game that most people are familiar with is poker. The challenge for the industry is to take poker's familiarity and simplicity and marry it with exciting, faster pace game play; games which take more than a few minutes to play to completion are generally not economically feasible for the gaming industry.

SUMMARY

It is an aspect of the present disclosure to provide a novel poker game enabling bonus bets for more exciting game play.

Further, it is an aspect of the present disclosure to provide a novel poker game enabling bonus bets that can be played via various means, such as a computing device (e.g., casino-type gaming machine (e.g., slot machine), PDA, personal computer, cellular telephone, etc.) and on a gaming table.

Further still, it is an aspect of the present disclosure to provide a set of programmable instructions capable of being stored within a memory of a computer system, a remote server accessible via the Internet, or on a computer-readable medium, such as a CD or a 3.5" diskette, and configured for execution by at least one processor for enabling a player to play the novel poker game enabling bonus bets.

In accordance with the aspects of the present disclosure, the present disclosure provides a novel poker game enabling bonus bets which can be played on a computing device or on a gaming table. An example of a preferred computing device is a casino-type video game system, such as a slot machine, having a touch screen and/or buttons for receiving player inputs and configured for receiving and awarding money.

In the computerized and gaming table versions of the poker game of the present disclosure, the player plays a poker game with the option to place bonus bets. In accordance with the present disclosure, the player can have the option of placing the following bonus bets: the total of the two player dealt cards is under 13; the total of the two player dealt cards is over 13; two player dealt cards are red cards (diamonds and hearts); two player dealt cards are black cards (clubs and spades); two player dealt cards are a pair (e.g., two jacks); two player dealt cards total 16; two player dealt cards total 17; two player dealt cards total 18; two player dealt cards total 19; two player dealt cards total 20; two player dealt cards total 17 or 18; two player dealt cards total 19 or 20; two player dealt cards total a number from 16 to 20; and two player dealt cards total 20 or a number from 16 to 18. Other bonus bets can also be provided as options to the player.

In another version of the game of the present disclosure, the player prior to playing a one-on-one poker game against the dealer where community cards are also used has the option of placing bonus bets, such as the bonus bets described in the previous paragraph.

DETAILED DESCRIPTION

The present disclosure provides a method and system for playing a poker game enabling bonus bets where the player can opt to place zero or at least one bonus bet. The game can be played on a computing device (electronic version), on a gaming table (table version), or as a board game.

Figure 9:
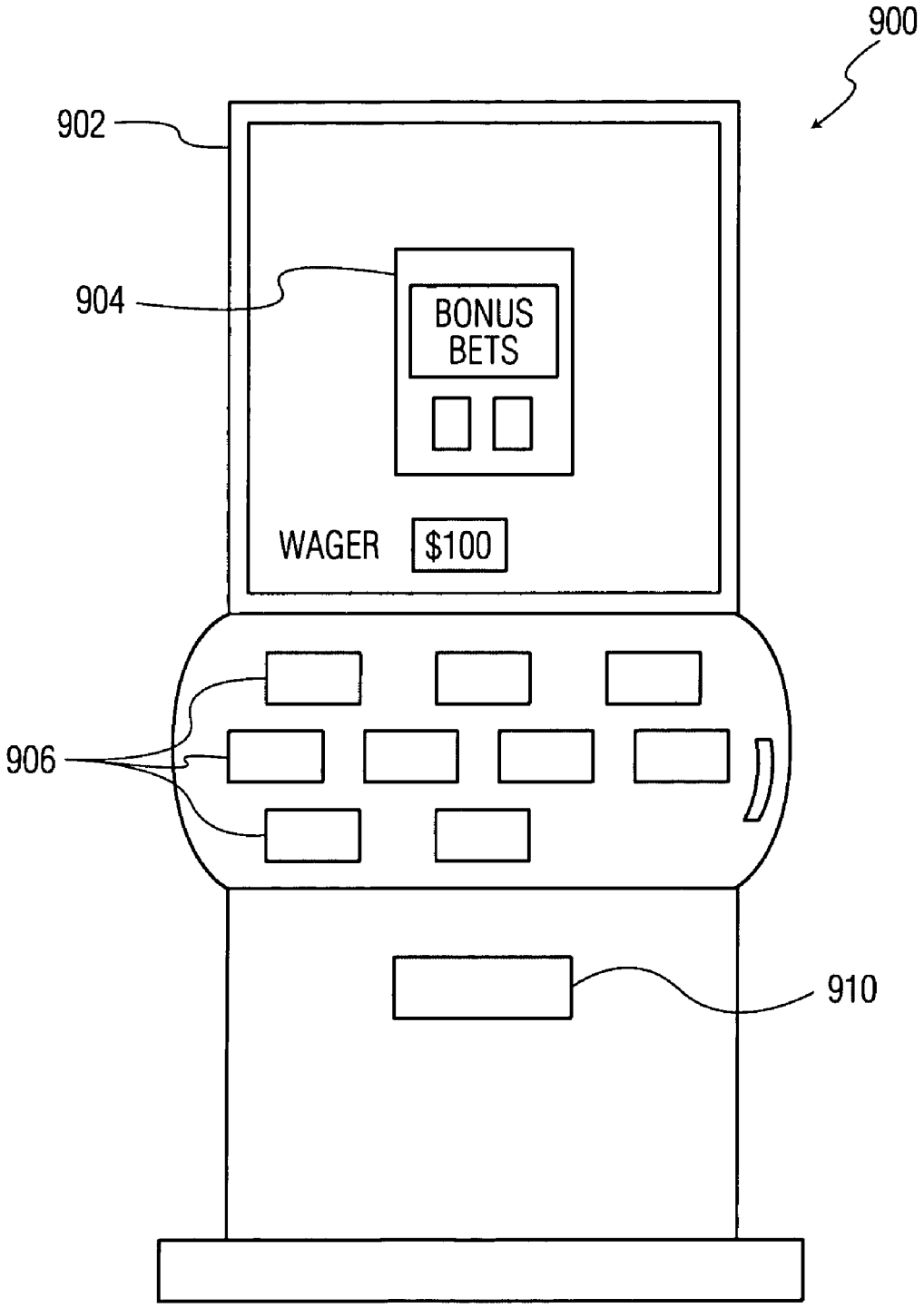
FIG. 9 is a schematic illustration of a slot machine device in accordance with the present disclosure.

An example of a preferred computing device is a casino-type gaming machine, such as a slot machine, having a touch screen and/or buttons for receiving player inputs and configured for receiving and awarding money as shown by FIG. 9 and designated by reference numeral 900. Other computing devices for playing the game are envisioned, such as a PDA, personal computer, cellular telephone, etc.

Hence, even though the description provided in the section below titled "Exemplary Game Play" in conjunction with the figures describe the implementation of the two versions of the game according to the present disclosure as table games, it is envisioned that the two versions of the game can be implemented as a set of programmable instructions or in some other format for execution by at least one processor embedded within a gaming system.

Specifically, the game described herein can be formatted/designed for play by at least one player (e.g. one player or multi-player) using a set of programmable instructions stored on computer-readable media, such as magnetic, optical, opto-magnetic, electronic, etc., and capable of being executed by at least one processor for individual play (one player) or multiple play (multiple players) utilizing:

- stand-alone computing devices (casino machines, game consoles, computers, kiosks, etc.) to access the set of programmable instructions stored on the device or electronically access a playable version of the game via the internet or other local-area-networks (LAN) or wide-area-networks (WAN);

handheld computing devices both hard wired or wireless (PDA's, cell phones, media players, etc.) to access the set of programmable instructions stored on the device or electronically access a the set of programmable instructions of the game via the internet, or other local-area-networks (LAN), or wide-area-networks (WAN); and interactive TV devices (set-top boxes, etc.) to access the set of programmable instructions over a closed network (cable, satellite, etc.) or broadcast TV networks (including live TV game shows).

Both versions the game of the present disclosure use standard poker rules where a poker hand can have the following rankings: royal flush, straight flush, four-of-a-kind, full house, flush, straight, three-of-a-kind, two pair and pair. For both versions of the game, at least one standard deck of 52 cards is used and the bonus bet(s), if any, is processed using two dealt cards before the poker game proceeds forward with the dealing of additional cards. It is contemplated that the game can be played with multiple players.

Exemplary Game Play

Table Game Version Number 1:

With reference to FIGS. 1–4, there is shown an exemplary game play of a table game in accordance with the present disclosure. The table game is played on a table having a layout 100 with multiple player sections 102 for allowing more than one player to play during each game play. The figures are superimposed with a poker pay table 104 and a bonus bet pay table 106 for providing a quick reference on how a player's poker bet and bonus bet winnings are determined.

The figures are also superimposed with three boxes labeled BANK 108, BET 110 and WINNINGS 112 for ease of reference in describing the game. The box labeled BANK 108 indicates how much monetary units, credits, points, etc. the player has. The box labeled BET 110 indicates how much monetary units, credits, points, etc. the player has wagered during a particular game play. The box labeled WINNINGS 112 indicates how much monetary units, credits, points, etc. the player has won during a particular game play.

Figure 1:
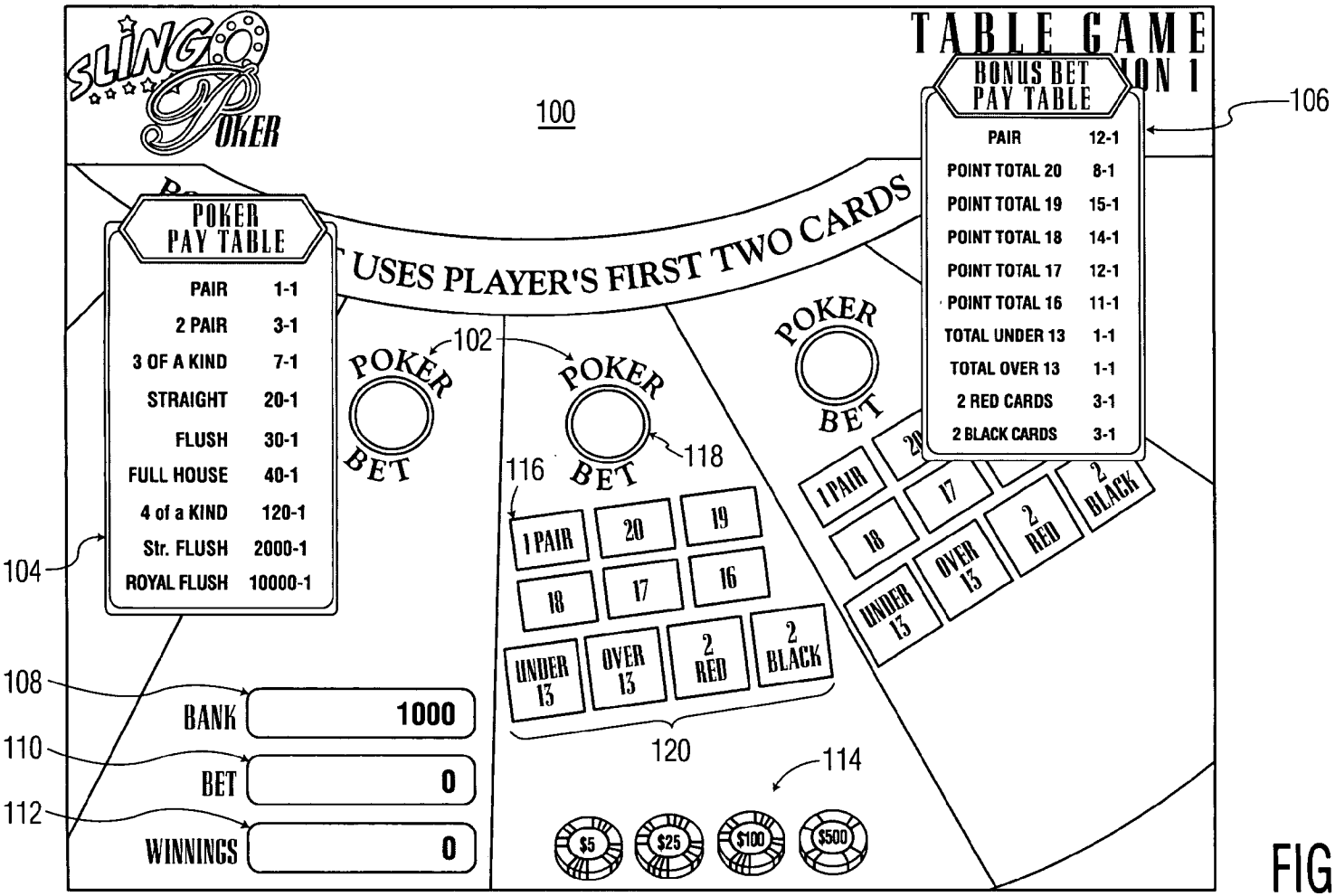
FIGS. 1–4 are views of an exemplary game play of a table game in accordance with the present disclosure.

In FIG. 1, prior to initiating game play, the player has 1000 monetary units, credits, points, etc. as indicated by the box labeled BANK 108. The player also has chips 114 for enabling him to place bonus bets in a bonus bet section 116 of the layout 100 and poker bets in a poker bet section 118 of the layout 100. The bonus bet section 116 includes a plurality of areas 120 for placing the bonus bets.

Figure 4:
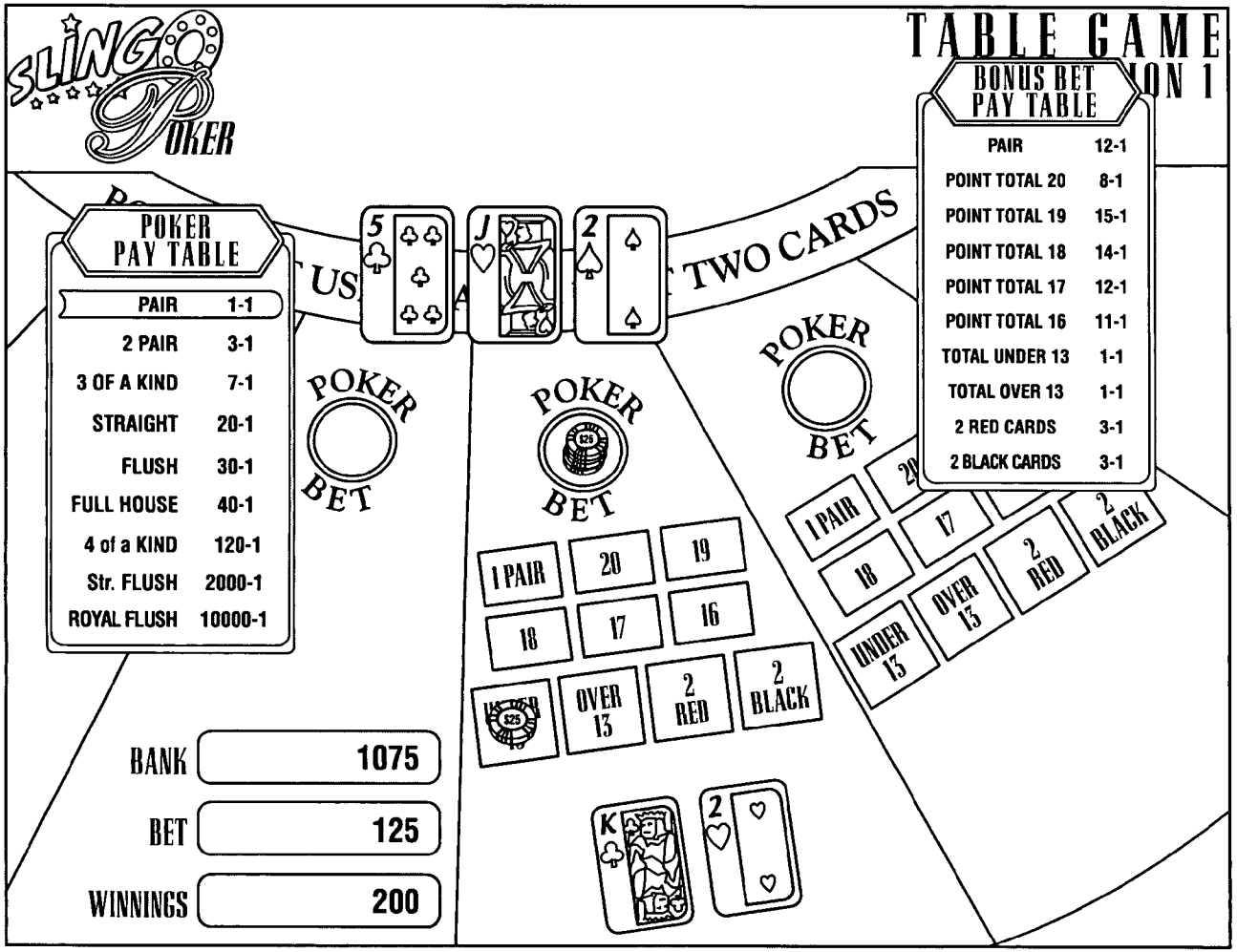
Figure 4A:
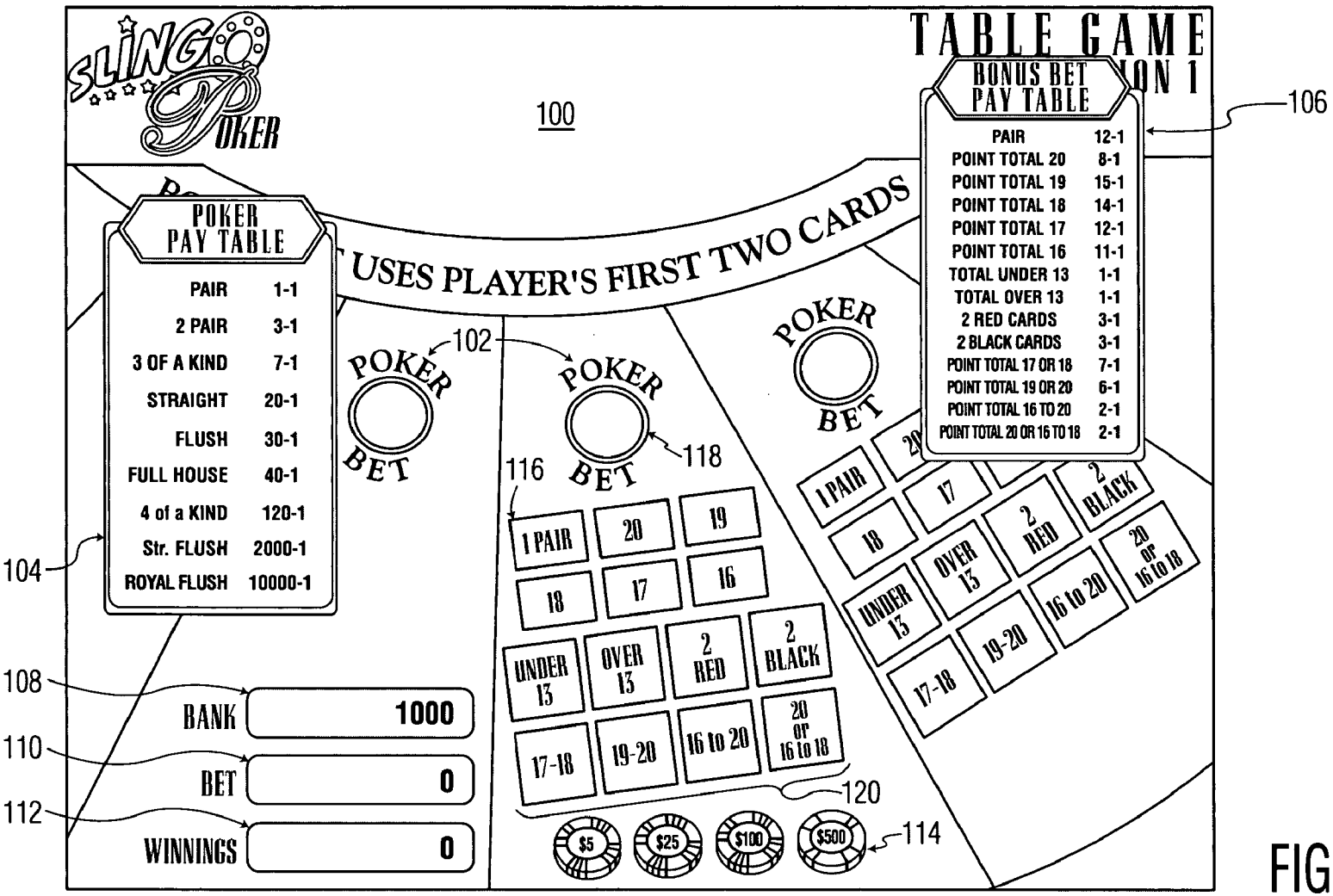
FIG. 4A is a view of a table game format for playing a table game in accordance with the present disclosure.

The plurality of areas 120 include the following bonus bets: the total of the two player dealt cards is under 13; the total of the two player dealt cards is over 13; two player dealt cards are red cards (diamonds and hearts); two player dealt cards are black cards (clubs and spades); two player dealt cards are a pair (e.g., two jacks); two player dealt cards total 16; two player dealt cards total 17; two player dealt cards total 18; two player dealt cards total 19; and two player dealt cards total 20. In an alternate variation of this table game version, the plurality of areas 120 also include the following bonus bets: two player dealt cards total 17 or 18; two player dealt cards total 19 or 20; two player dealt cards total a number from 16 to 20; and two player dealt cards total a number from 16 to 18 or 20 (see FIG. 4A).

Figure 2:
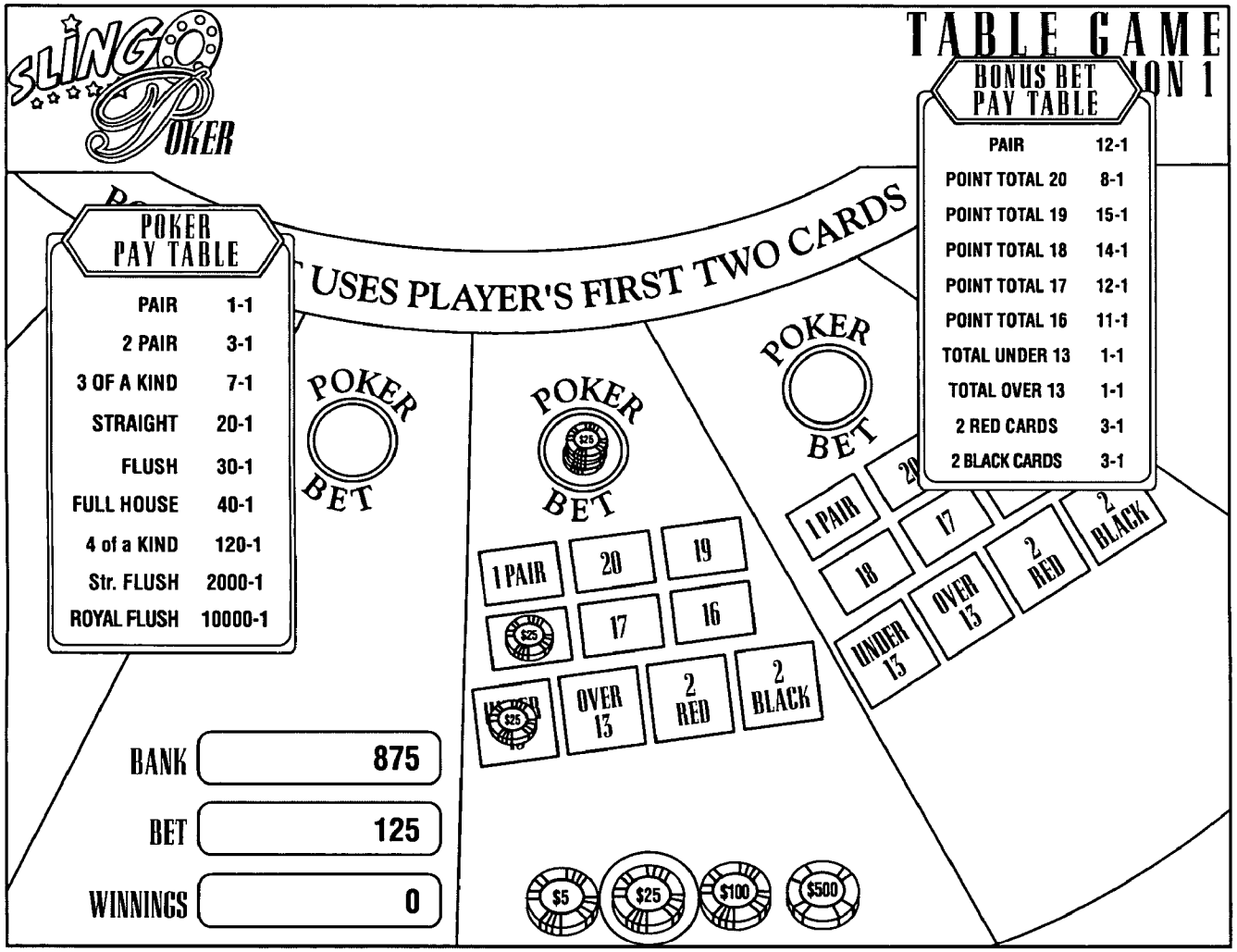

With reference to FIG. 2, the player placed a $25 bonus bet that the two player dealt cards would have a total of less than 13 and a $25 bonus bet that the two player dealt cards would total 18. The player also placed a $75 poker bet that his two dealt cards plus the three community cards will include a poker win (i.e., one of the nine outcomes shown by the poker pay table 104). Accordingly, the box labeled BANK 108 indicates that the player has a total of 875 monetary units, credits, points, etc. Further, the box labeled BET 110 indicates that the player has bet a total of 125 monetary units, credits, points, etc.

Figure 3:
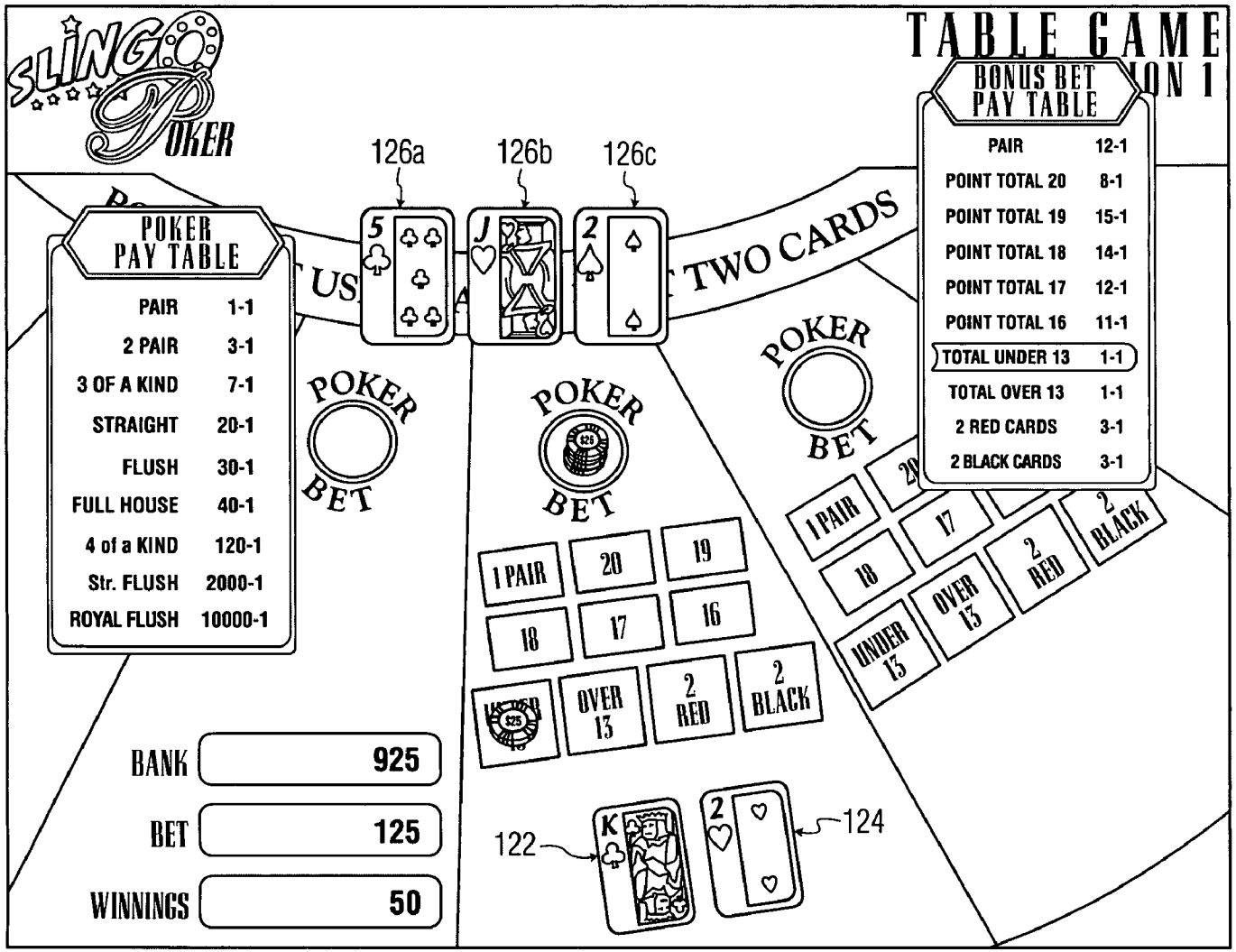

With reference to FIG. 3, the player is dealt two cards 122, 124 which are a king of clubs and a two of hearts. Hence, the player's bonus bet of the two player dealt cards having a total of less than 13 wins the player $25 plus the player's original $25 bonus bet as indicated by the bonus bet pay table 106. Accordingly, the boxes labeled BANK 108 and WINNINGS 112 are increased by $50. The other bonus bet that the two player dealt cards would total 18 does not win the player any winnings.

The three community cards 126*a, b, c* include a five of clubs, a jack of hearts and a two of spades. As indicated by the poker pay table 104 on FIG. 4, the five displayed cards which form the poker hand include a pair (the two of spades and the two of hearts). Hence, the player is awarded $75 for the poker win plus the player's original $75 poker bet. Accordingly, the boxes labeled BANK 108 and WINNINGS 112 are increased by $150.

Table Game Version Number 2:

With reference to FIGS. 5–8, there is shown an exemplary game play of a table game in accordance with the present disclosure. The table game is played on a table having a layout 200 with multiple player sections 202 for allowing more than one player to play during each game play. The layout 200 is similar to the layout 100 shown by FIGS. 1–4. FIGS. 5–8 are superimposed with a bonus bet pay table 206 for providing a quick reference on how a player's bonus bet winnings are determined.

The figures are also superimposed with three boxes labeled BANK 208, BET 210 and WINNINGS 212 for ease of reference in describing the game. The box labeled BANK 208 indicates how much monetary units, credits, points, etc. the player has. The box labeled BET 210 indicates how much monetary units, credits, points, etc. the player has wagered during a particular game play. The box labeled WINNINGS 212 indicates how much monetary units, credits, points, etc. the player has won during a particular game play.

Figure 5:
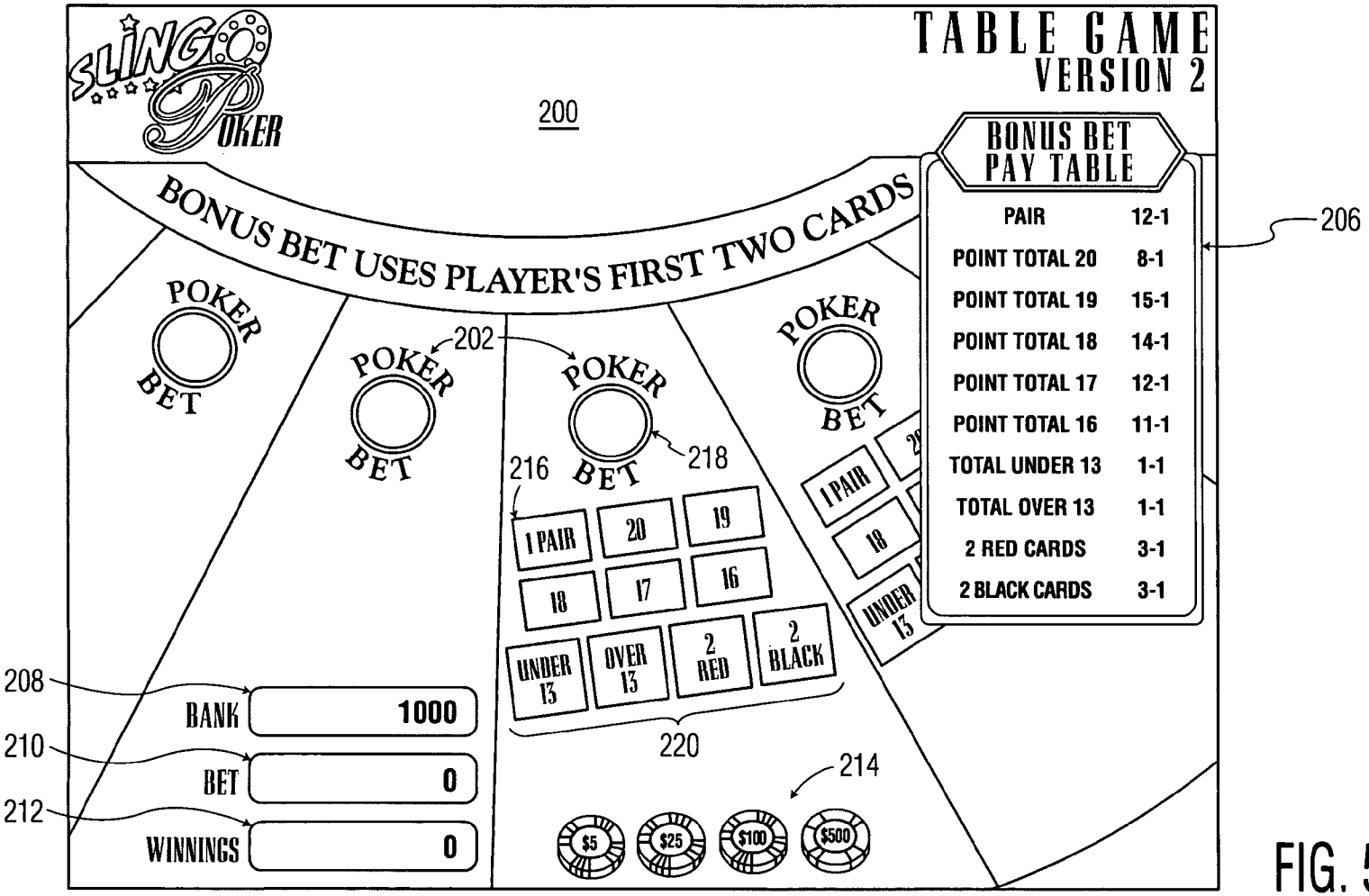
FIGS. 5–8 are views of an exemplary game play of a table game in accordance with the present disclosure.

In FIG. 5, prior to initiating game play, the player has 1000 monetary units, credits, points, etc. as indicated by the box labeled BANK 208. The player also has chips 214 for enabling him to place bonus bets in a bonus bet section 216 of the layout 200 and poker bets in a poker bet section 218 of the layout 200. The bonus bet section 216 includes a plurality of areas 220 for placing the bonus bets.

The plurality of areas 220 include the following bonus bets: the total of the two player dealt cards is under 13; the total of the two player dealt cards is over 13; two player dealt cards are red cards (diamonds and hearts); two player dealt cards are black cards (clubs and spades); two player dealt cards are a pair (e.g., two jacks); two player dealt cards total 16; two player dealt cards total 17; two player dealt cards total 18; two player dealt cards total 19; and two player dealt cards total 20. In an alternate variation of this table game version, the plurality of areas 220 can also include the following bonus bets: two player dealt cards total 17 or 18; two player dealt cards total 19 or 20; two player dealt cards total a number from 16 to 20; and two player dealt cards total 20 or a number from 16 to 18.

Figure 6:
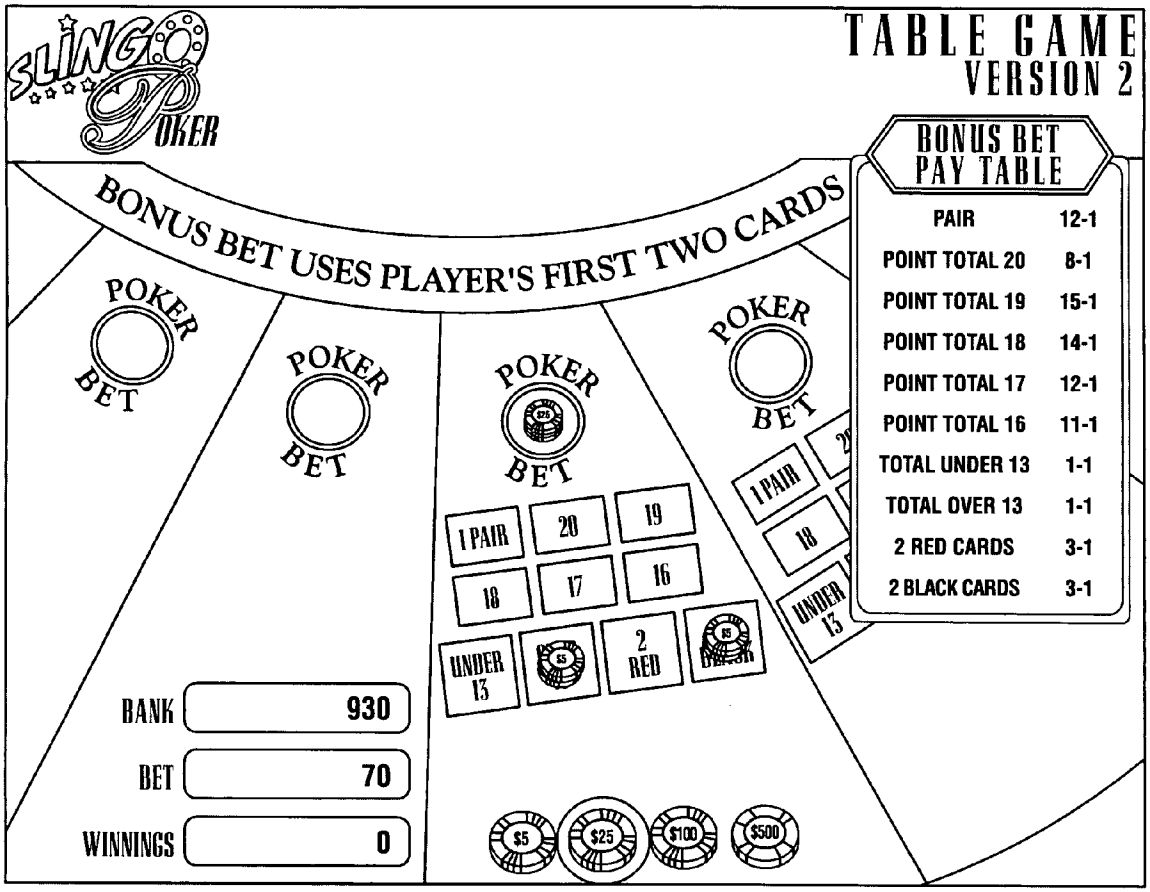

With reference to FIG. 6, the player placed a $10 bonus bet that the two player dealt cards would have a total of greater than 13 and a $10 bonus bet that the two player dealt cards will be two black cards. The player also placed a $50 poker bet that his two dealt cards plus the three community cards will be a better poker hand than the poker hand dealt to the dealer. Accordingly, the box labeled BANK 208 indicates that the player has a total of 930 monetary units, credits, points, etc. Further, the box labeled BET 210 indicates that the player has bet a total of 70 monetary units, credits, points, etc.

Figure 7:
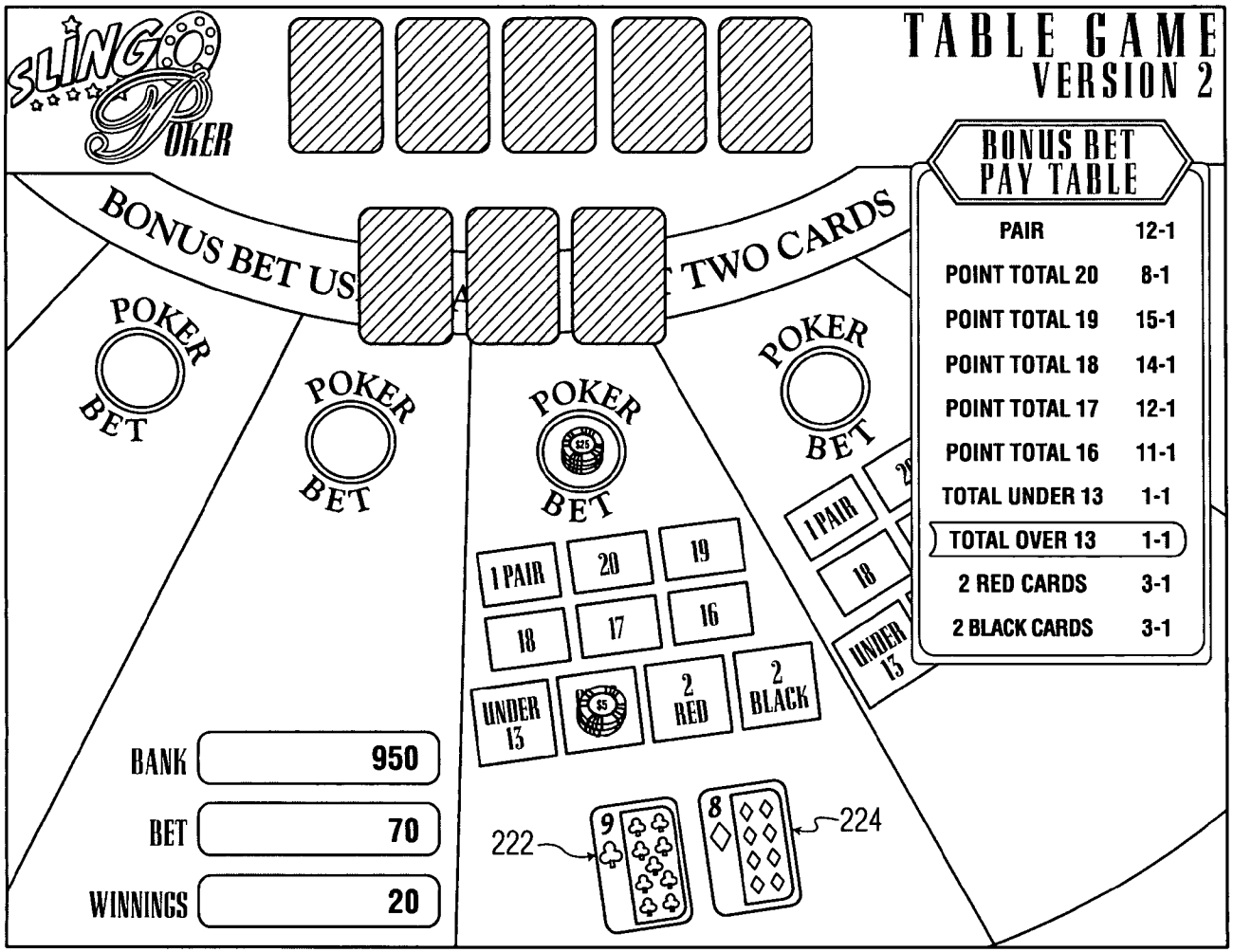

With reference to FIG. 7, the player is dealt two cards 222, 224 which are a nine of clubs and an eight of diamonds. Hence, the player's bonus bet of the two player dealt cards having a total of greater than 13 wins the player $10 plus the player's original $10 bonus bet as indicated by the bonus bet pay table 206. Accordingly, the boxes labeled BANK 208 and WINNINGS 212 are increased by $20. The other bonus bet that the two player dealt cards would be two black cards does not win the player any winnings.

Figure 8:
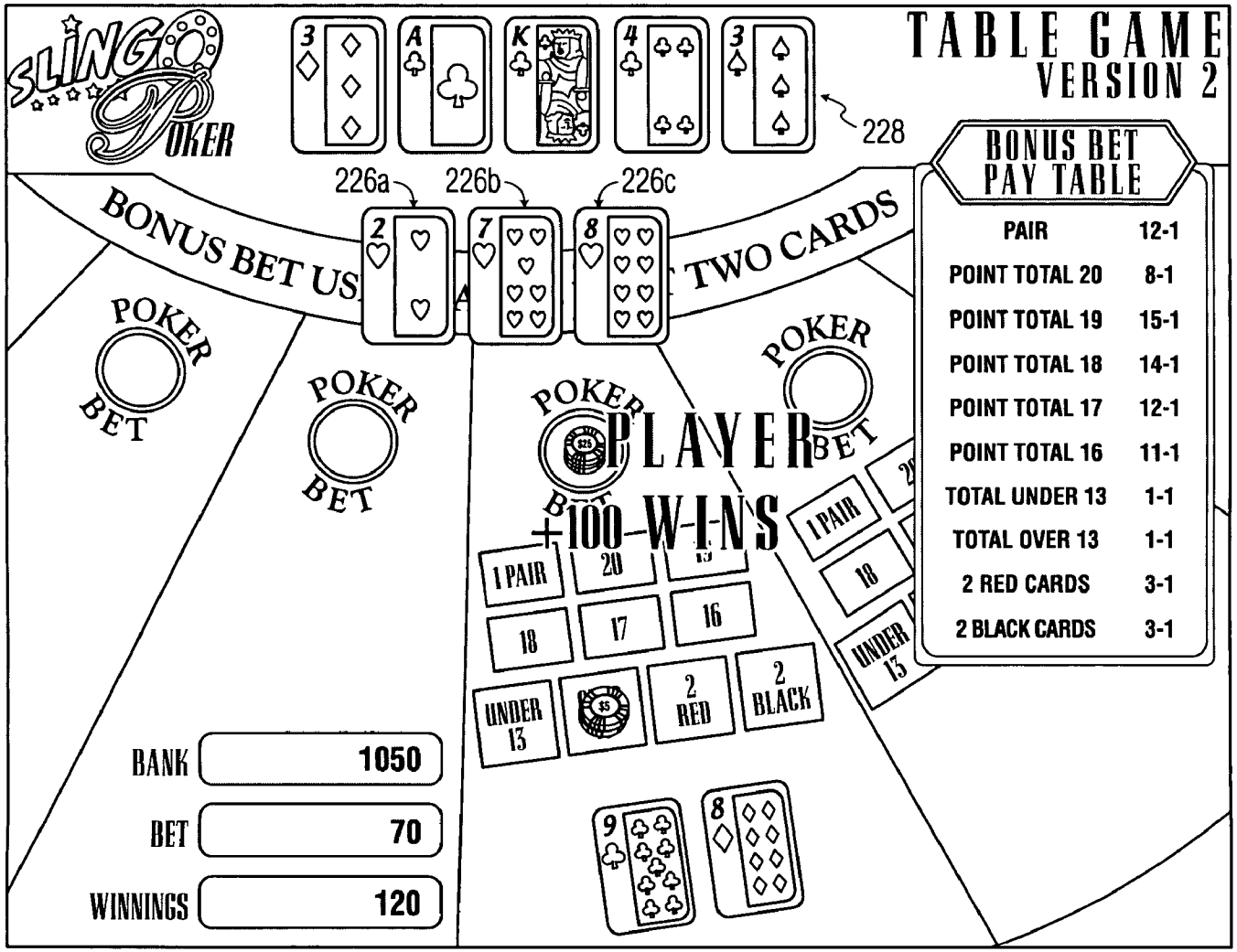

With reference to FIG. 8, the three community cards 226*a, b, c* are turned over and include a two of hearts, a seven of hearts and an eight of hearts. The dealer's hand 228 includes a three of diamonds, an ace of clubs, a king of clubs, a four of clubs and a three of spades. Since the player's two dealt cards and the three community cards form a better poker hand than the dealer's hand, the player wins his poker bet. Hence, the player is awarded $50 for the poker win plus the player's original $50 poker bet. Accordingly, the box labeled WINNINGS 212 is increased by $100.

FIG. 9 shows the game implemented as a casino-type gaming machine 900. The gaming machine 900 includes a display unit 902, such as a touch-screen display unit, for displaying a graphical user interface 904 and a plurality of buttons 906 for initiating and enabling play of the game described herein. The game can also be initiated and played by touching the touch-screen display unit 902. A slot 908 is provided for receiving money and a bin 910 is provided for dispensing winnings.

What has been described herein is merely illustrative of the principles of the present disclosure. For example, the electronic and table versions of the game described herein and implemented as the best mode for playing the game are for illustration purposes only. Other arrangements and methods may be implemented by those skilled in the art without departing from the scope and spirit of the present disclosure.

The invention claimed is:

1. A method of playing a card game, comprising:

dealing two cards to a player to form a two-card hand;

resolving said two-card hand in accordance with predetermined rules, wherein said predetermined rules includes a rule of whether the two dealt cards have a total value within a predetermined range of successive numbers or a total value equal to a predetermined number outside the predetermined range of successive numbers, and not in sequence relative to the predetermined range of successive numbers wherein said resolving step comprises:

determining if the player placed a non-poker game-related bet on only one predetermined area corresponding to the player and corresponding to whether the two dealt cards have a total value within a predetermined range of successive numbers or a total value equal to a predetermined number outside the predetermined range of successive numbers, and not in sequence relative to the predetermined range of successive numbers, and determining a payout to the player if the player placed the non-poker game-related bet on the only one predetermined area and if the two dealt cards have a total value within the predetermined range of successive numbers or a total value equal to the predetermined number outside the predetermined range of successive numbers, and not in sequence relative to the predetermined range of successive numbers, and continuing with a poker game.

2. The method according to claim 1, further comprising, prior to said dealing step, receiving at least a two-card hand wager from said player.

3. The method according to claim 2, wherein said resolving step is practiced by paying a payout based on the two-card hand wager if the player's two dealt cards provide a winning two-card hand in accordance with the predetermined rules.

4. The method according to claim 1, further comprising, prior to said dealing step, receiving zero or at least one non-poker game-related bet from said player.

5. The method according to claim 4, wherein said at least one non-poker game-related bet is resolved in accordance with the predetermined rules, and said at least one non-poker game-related bet is selected from the group consisting of said two-card hand comprising two red cards, said two-card hand comprising two black cards, said two-card hand comprising cards having a total value less than a predetermined number, said two-card hand comprising cards having a total value greater than a predetermined number, said two-card hand comprising cards having a total value equal to a predetermined number, said two-card hand comprising cards having a total value equal to one of two predetermined numbers, said two-card hand comprising cards having a total value within a predetermined range, as well as said two-card hand comprising cards having a total value within the predetermined range or a total value equal to the predetermined number.

6. The method according to claim 5, wherein the resolving step comprises the step of applying the predetermined rules to the at least one non-poker game-related bet to determine whether the player is a winner.

7. The method according to claim 1, further comprising, prior to said dealing step, receiving at least one poker game-related bet from said player.

8. The method according to claim 1, wherein said game is played on a gaming table having a first predefined area for receiving zero or at least one non-poker game-related bet and a second predefined area for receiving a poker game-related bet.

9. The method according to claim 1, wherein said game is played over a network.

10. The method according to claim 1, wherein said game is played via a casino-type gaming machine.

11. The method according to claim 1, wherein said game is configured as a set of programmable instructions capable of being executed by at least one processor.

* * * * *